US007887149B2

(12) United States Patent
Kondoh

(10) Patent No.: US 7,887,149 B2
(45) Date of Patent: Feb. 15, 2011

(54) CAPACITIVE LOAD DRIVING CIRCUIT AND IMAGE FORMING DEVICE

(75) Inventor: Yoshinao Kondoh, Ibaraki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 734 days.

(21) Appl. No.: 11/897,307

(22) Filed: Aug. 30, 2007

(65) Prior Publication Data

US 2008/0186339 A1 Aug. 7, 2008

(30) Foreign Application Priority Data

Feb. 5, 2007 (JP) ..... 2007-026027

(51) Int. Cl.
*B41J 29/38* (2006.01)

(52) U.S. Cl. ..... 347/9; 347/10

(58) Field of Classification Search ..... None
See application file for complete search history.

(56) References Cited

U.S. PATENT DOCUMENTS 6,113,209 A * 9/2000 Nitta et al. ..... 347/9
2005/0231179 A1* 10/2005 Ishizaki ..... 323/234

FOREIGN PATENT DOCUMENTS

JP 2002-127412 5/2002
JP 2005-238847 9/2005

* cited by examiner

*Primary Examiner*—Omar Rojas
(74) *Attorney, Agent, or Firm*—Fildes & Outland, P.C.

(57) ABSTRACT

There is provided a capacitive load driving circuit connected to a capacitive load that causes ejection, from an ejecting nozzle, of a liquid droplet of a droplet amount that corresponds to a voltage level of charging voltage, the capacitive load driving circuit including: a first line that is connected to the capacitive load and that applies the charging voltage to the capacitive load; a power source line carrying dc voltage that is supplied from a power source for driving of the capacitive load; a charging control signal line that controls a voltage level of the charging voltage with respect to the capacitive load; and an N-type electric field effect transistor to whose source the first line is connected, and to whose drain the power source line is connected, and to whose gate the charging control signal line is connected.

11 Claims, 8 Drawing Sheets

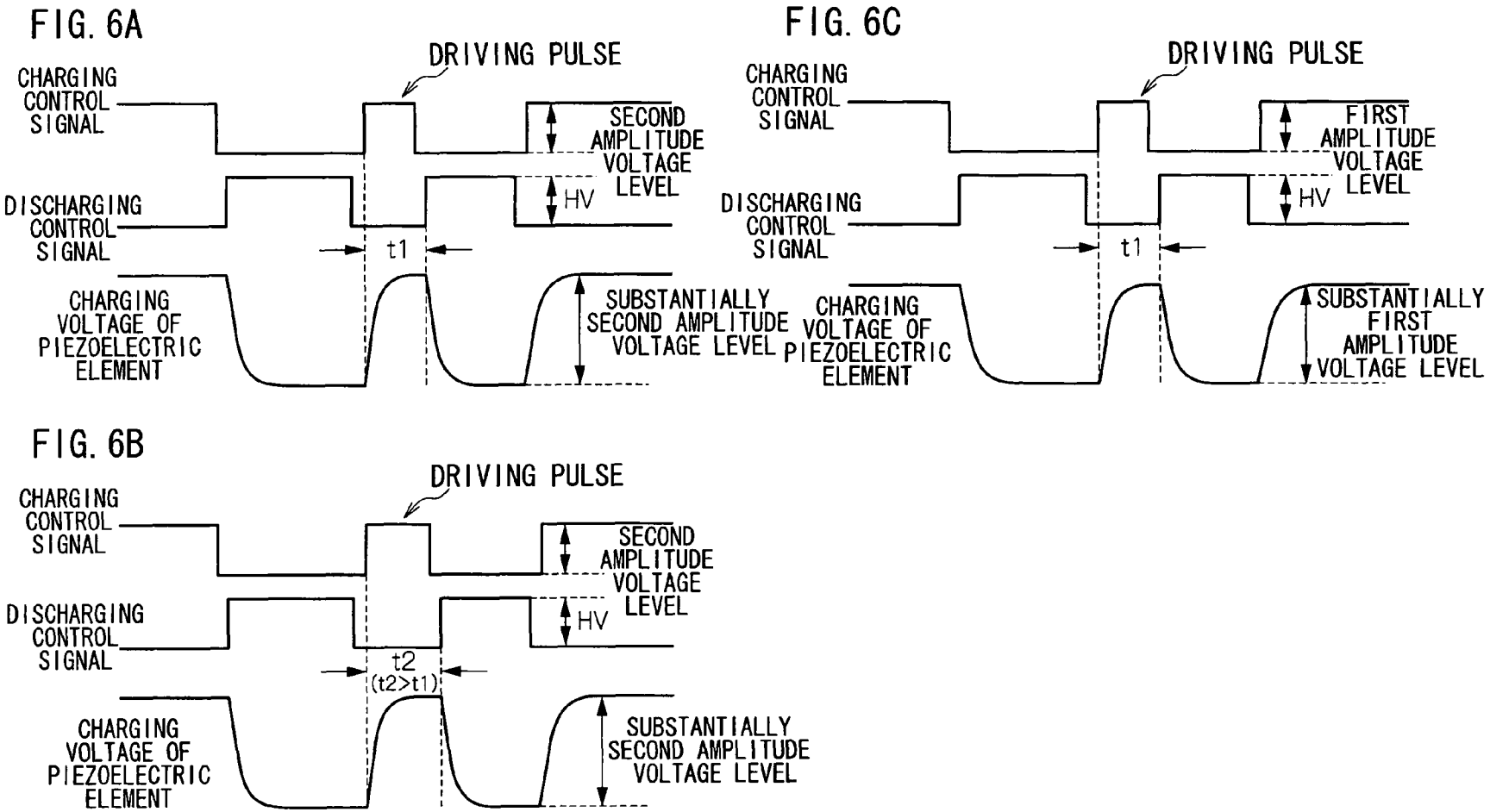
FIG. 6A
CHARGING CONTROL SIGNAL
DISCHARGING CONTROL SIGNAL
CHARGING VOLTAGE OF PIEZOELECTRIC ELEMENT
DRIVING PULSE
SECOND AMPLITUDE VOLTAGE LEVEL
HV
t1
SUBSTANTIALLY SECOND AMPLITUDE VOLTAGE LEVEL
FIG. 6B
CHARGING CONTROL SIGNAL
DISCHARGING CONTROL SIGNAL
CHARGING VOLTAGE OF PIEZOELECTRIC ELEMENT
DRIVING PULSE
SECOND AMPLITUDE VOLTAGE LEVEL
HV
t2
(t2>t1)
SUBSTANTIALLY SECOND AMPLITUDE VOLTAGE LEVEL
FIG. 6C
CHARGING CONTROL SIGNAL
DISCHARGING CONTROL SIGNAL
CHARGING VOLTAGE OF PIEZOELECTRIC ELEMENT
DRIVING PULSE
FIRST AMPLITUDE VOLTAGE LEVEL
HV
t1
SUBSTANTIALLY FIRST AMPLITUDE VOLTAGE LEVEL

CAPACITIVE LOAD DRIVING CIRCUIT AND IMAGE FORMING DEVICE

CROSS-REFERENCE TO RELATED APPLICATION

This application is based on and claims priority under 35 USC 119 from Japanese Patent Application No. 2007-026027 filed Feb. 5, 2007.

BACKGROUND

1. Technical Field

The present invention relates to a capacitive load driving circuit and an image forming device.

2. Related Art

There are conventionally known image forming devices such as inkjet printers and the like which eject an ink liquid from ejecting nozzles onto a recording medium and form an image.

In this type of image forming device, for example, by applying voltage from driving circuits to piezoelectric elements or the like which are capacitive loads and charging the piezoelectric elements, the piezoelectric elements are deformed and changes in volume are caused at pressure generating chambers in which an ink liquid is filled. Ink droplets are thereby ejected from ejecting nozzles which are spatially connected to the pressure generating chambers.

In such an image forming device, there are cases in which dispersion arises in the droplet amounts of the liquid droplets which are ejected from the ejecting nozzles, due to dispersion in the resistors which are built-in the driving circuits, or dispersion in the electrostatic capacities of the piezoelectric elements, or the like.

SUMMARY

According to an aspect of the invention, there is provided a capacitive load driving circuit connected to a capacitive load that causes ejection, from an ejecting nozzle, of a liquid droplet of a droplet amount that corresponds to a voltage level of charging voltage, the capacitive load driving circuit including: a first line that applies the charging voltage to the capacitive load; a power source line carrying dc voltage that is supplied from a power source for driving of the capacitive load; a charging control signal line that controls a voltage level of the charging voltage with respect to the capacitive load; and an N-type electric field effect transistor to whose source the first line is connected, and to whose drain the power source line is connected, and to whose gate the charging control signal line is connected.

BRIEF DESCRIPTION OF THE DRAWINGS

Exemplary embodiments of the present invention will be described in detail based on the following figures wherein:

FIG. 6A is a waveform diagram showing examples of a charging control signal and a discharging control signal relating to the first exemplary embodiment;

FIG. 6B is a waveform diagram showing examples of a charging control signal and a discharging control signal relating to the first exemplary embodiment;

FIG. 6C is a waveform diagram showing examples of a charging control signal and a discharging control signal relating to the first exemplary embodiment;

DETAILED DESCRIPTION

Exemplary embodiments of the present invention will be described in detail hereinafter with reference to the drawings. Note that a case in which the present invention is applied to an inkjet printer (an image forming device) will be described hereinafter.

First Exemplary Embodiment

Figure 1:
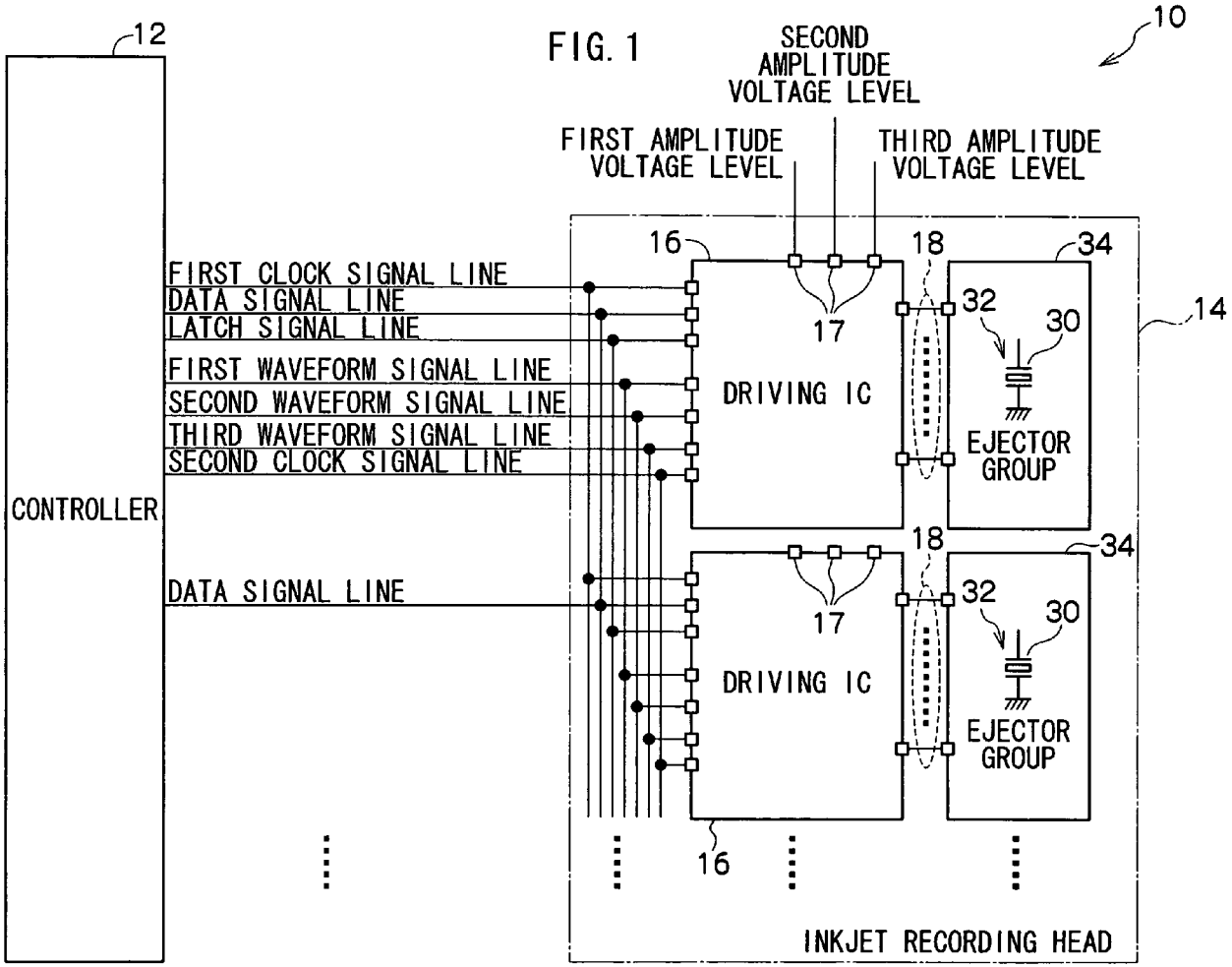
FIG. 1 is a schematic drawing showing the structure of main portions of an inkjet printer relating to the exemplary embodiments.

FIG. 1 is a drawing showing the structure of main portions of an inkjet printer (hereinafter called "printer") 10 relating to the present exemplary embodiment. Mainly the structure of peripheral portions of an inkjet recording head, except for a recording sheet conveying system, is illustrated in FIG. 1.

As shown in FIG. 1, the printer 10 relating to the present exemplary embodiment has a controller 12 and an inkjet recording head 14. The controller 12 governs the overall operations of the printer 10. The inkjet recording head 14 ejects ink droplets on the basis of supplied print data. The inkjet recording head 14 has plural ejector groups 34 and driving ICs (Integrated Circuits) 16 which are provided in respective correspondence with the ejector groups 34. The ejector groups 34 are structured such that plural ejectors 32, which eject ink droplets due to the deformation of piezoelectric elements (piezo elements) 30 provided individually thereat, are arranged two-dimensionally.

The inkjet recording head 14 relating to the present exemplary embodiment is an elongated structure whose width is substantially equal to the width of a recording sheet. Namely, the present printer 10 is structured as an inkjet printer which carries out recording on the entire width of a recording sheet all at once by ejecting ink droplets from the respective ejectors 32 while conveying only the recording sheet with the inkjet recording head 14 remaining fixed.

The ejector 32 relating to the present exemplary embodiment is structured so as to include a pressure generating chamber in which a chromatic ink liquid is filled, an ejecting nozzle which is spatially connected to the pressure generating chamber and which can eject ink, and an actuator. The actuator has a vibrating plate structuring a portion of a wall surface of the pressure generating chamber and expanding or contracting the pressure generating chamber by vibrating, and has a piezoelectric element 30 which vibrates the vibrating plate by deforming due to voltage which is applied thereto in accordance with image data expressing the image to be recorded.

All of the driving ICs 16 provided at the inkjet recording head 14, and the controller 12, are connected by a common first clock signal line, latch signal line, first waveform signal line, second waveform signal line, third waveform signal line, and second clock signal line. Further, the controller 12 is connected individually to each driving IC 16 by a data signal line.

Operation of each driving IC 16 is controlled by the controller 12 using a first clock signal supplied via the first clock signal line; print data supplied via the data signal line; control data; amplitude data; a latch signal supplied via the latch signal line; a waveform signal A supplied via the first waveform signal line; a waveform signal B supplied via the second waveform signal line; a waveform signal C supplied via the third waveform signal line; a second clock signal supplied via the second clock signal line; and the like.

Plural (here, three) amplitude setting terminals 17 are provided at the driving IC 16. Plural electric powers of respectively different voltage levels are supplied to the respective amplitude setting terminals 17. At the driving IC 16 relating to the present exemplary embodiment, electric power of a first amplitude voltage level (18 V in the present exemplary embodiment), electric power of a second amplitude voltage level (20 V in the present exemplary embodiment), and electric power of a third amplitude voltage level (22 V in the present exemplary embodiment) are supplied to the three amplitude setting terminals 17 from three power sources (not shown), respectively.

When image data which expresses an image to be printed is inputted to the controller 12 from an external device such as a personal computer or the like, the controller 12 outputs print data on the basis of this image data. The print data expresses the droplet amounts of the liquid droplets which are to be ejected from the respective ejectors 32 provided at the inkjet recording head 14.

Further, the controller 12 stores correction data in advance, and outputs amplitude data and control data on the basis of this correction data. The correction data is for correcting dispersion in the droplet amounts of the liquid droplets ejected from the respective ejectors 32 which is caused by dispersion in the resistors which are built-in the driving ICs 16, dispersion in the electrostatic capacities of the piezoelectric elements 30, and the like.

Figure 2:
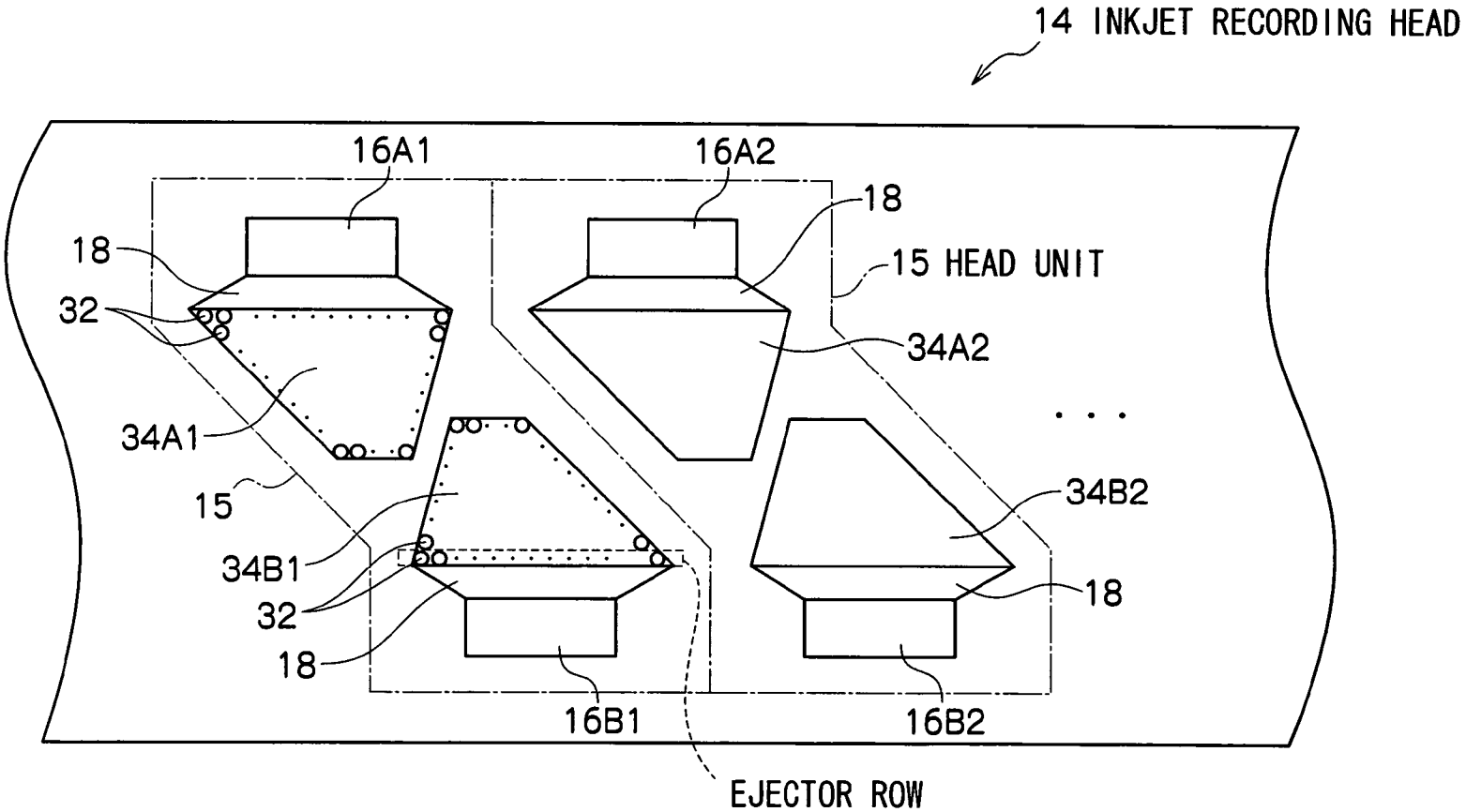
FIG. 2 is a plan view showing the schematic structure of an inkjet recording head relating to the exemplary embodiments.

A plan view showing the schematic structure of the inkjet recording head 14 relating to the present exemplary embodiment is shown in FIG. 2.

As shown in FIG. 2, at the inkjet recording head 14 relating to the present exemplary embodiment, plural unit structures are disposed, with respect to a predetermined one direction (the longitudinal direction (elongated direction) of the inkjet recording head 14), such that partial regions at the end portions of ejector groups which are disposed at adjacent unit structures, overlap one another. The unit structures are respectively ejector groups 34A1, 34B1, 34A2, 34B2, . . . , which are structured by plural ejectors 32 being arranged two-dimensionally.

Driving ICs 16A1, 16B1, 16A2, 16B2 . . . are provided individually in a one-to-one correspondence with the ejector groups 34A1, 34B1, 34A2, 34B2, . . . . The ejector group and the corresponding driving IC are electrically connected by a connecting line 18. Note that, hereinafter, the ejector groups 34A1, 34B1, 34A2, 34B2, . . . are abbreviated as "the ejector group 34", other than in cases of designating a specific ejector group. Further, hereinafter, the driving ICs 16A1, 16B1, 16A2, 16B2 . . . are abbreviated as "the driving IC 16", other than in cases of designating a specific driving IC.

The configuration of the region where the ejector group 34 relating to the present exemplary embodiment is disposed is a trapezoidal configuration in which the angles of the two inclined sides connecting the top side and the bottom side are different from one another. Plural ejector rows, in each of which plural ejectors 32 are lined-up at predetermined intervals in a direction orthogonal to the conveying direction of the recording sheet, are provided in parallel lines at the aforementioned region where the ejector group 34 is disposed. Further, the ejector rows are lined-up such that the ejectors 32 of each ejector row are not superposed on the ejectors 32 of the other ejector rows with respect to the conveying direction.

In the inkjet recording head 14 relating to the present exemplary embodiment, the respective bottom sides of a pair of ejector groups 34 are disposed so as to oppose one another facing a longitudinal direction central line of the inkjet recording head 14. The ICs 16 corresponding to the respective ejectors groups 34 are disposed integrally therewith. In this way, a head unit 15 serving as a unit part is structured. The inkjet recording head 14 is structured in a state in which a plurality of these head units 15 are lined-up in the longitudinal direction.

Figure 3:
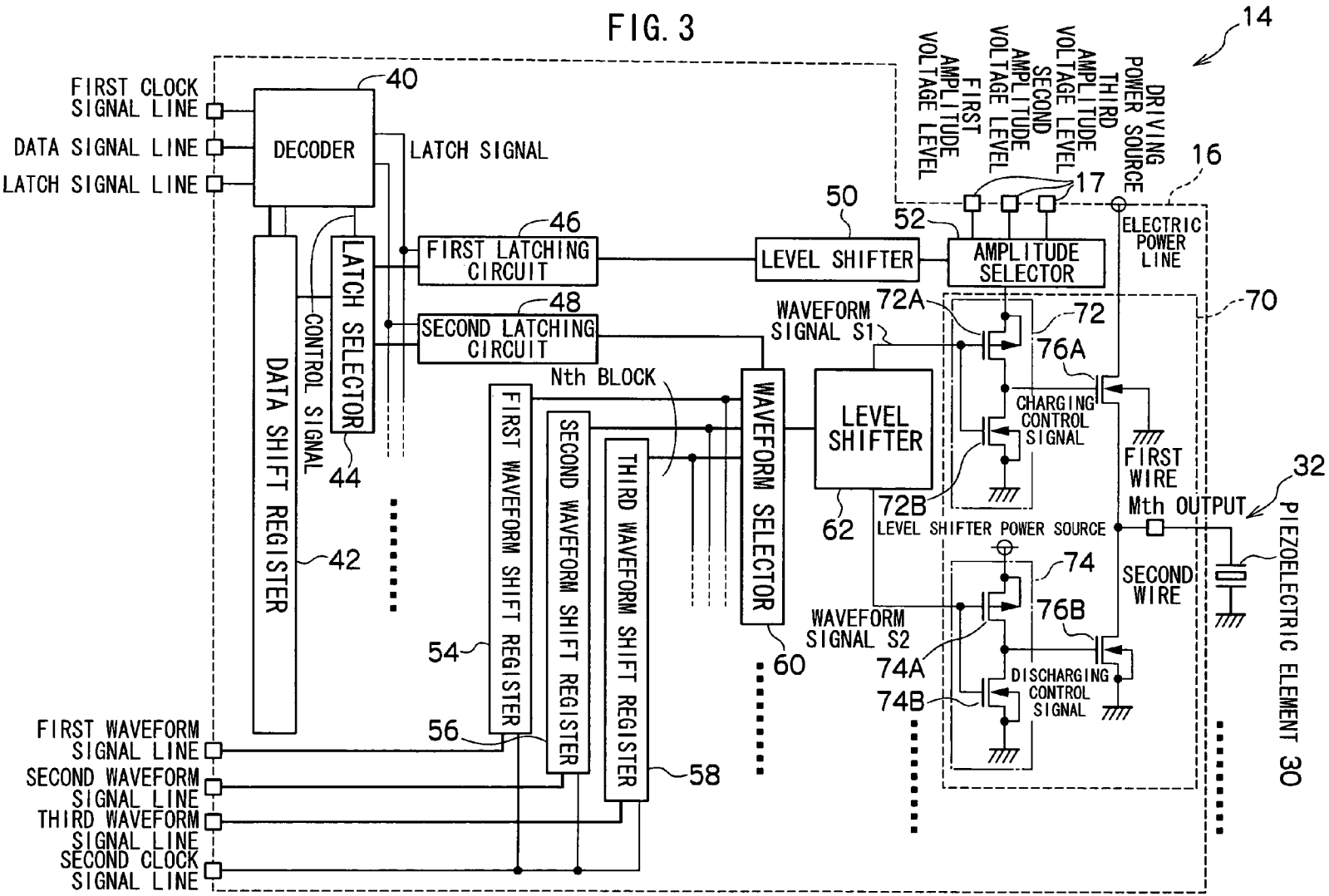
FIG. 3 is a block diagram (a partial circuit diagram) showing the structure of main portions of a driving IC relating to a first exemplary embodiment.

The structure of the driving IC 16 relating to the present exemplary embodiment is shown in FIG. 3.

As shown in FIG. 3, the driving IC 16 relating to the present exemplary embodiment has a decoder 40, a data shift register 42, a latch selector 44, a first latching circuit 46, a second latching circuit 48, a level shifter 50, a amplitude selector (first selector) 52, a first waveform shift register 54, a second waveform shift register 56, a third waveform shift register 58, a waveform selector 60, a level shifter 62, and a driving waveform generating circuit 70.

At the driving IC 16 relating to the present exemplary embodiment, the decoder 40 and the data shift register 42 are provided for each driving IC 16. The latch selector 44, the first latching circuit 46, the second latching circuit 48, the level shifter 50, the amplitude selector 52, the waveform selector 60, the level shifter 62, and the driving waveform generating circuit 70 are provided for each ejector 32. The first waveform shift register 54, the second waveform shift register 56, and the third waveform shift register 58 are provided for each ejector row of each ejector group 34.

The first clock signal line, the data signal line, and the latch signal line are connected to the decoder 40. The first waveform signal line is connected to the first waveform shift register 54, the second waveform signal line is connected to the second waveform shift register 56, and the third waveform signal line is connected to the third waveform shift register 58. The second clock signal line is connected in parallel to the first waveform shift register 54, the second waveform shift register 56, and the third waveform shift register 58.

The first clock signal, the print data, the control data, the amplitude data, and the latch signal which are outputted from the controller 12 are inputted to the decoder 40. The waveform signals A, B, C which are outputted from the controller 12 are inputted to the first waveform shift register 54, the second waveform shift register 56, and the third waveform shift register 58, respectively. Moreover, the second clock signal outputted from the controller 12 is respectively inputted to the first waveform shift register 54, the second waveform shift register 56, and the third waveform shift register 58.

The control data is data designating whether the output destination of data from the latch selector 44 is to be the first latching circuit 46 or the second latching circuit 48. The present exemplary embodiment utilizes 1-bit data in which "0" expresses that the first latching circuit 46 is designated as the output destination of the data, and "1" expresses that the second latching circuit 48 is designated as the output destination of the data.

The amplitude data is data designating the amplitude voltage level which is to be used, from among a first amplitude voltage level, a second amplitude voltage level, and a third amplitude voltage level. In the present exemplary embodiment, 3-bit serial data is used. For example, "001" expresses that the first amplitude voltage level is to be applied, "010" expresses that the second amplitude voltage level is to be applied, and "100" expresses that the third amplitude voltage level is to be applied, as the amplitude voltage level to be used.

The print data is data which designates the waveform signal to be used for ejecting the liquid droplet, from among the waveform signal A, the waveform signal B, and the waveform signal C. In the present exemplary embodiment, 3-bit serial data is used. For example, "001" expresses that waveform signal A is to be applied, "010" expresses that waveform signal B is to be applied, and "100" expresses that waveform signal C is to be applied, as the waveform signal to be used.

In the present exemplary embodiment, a number of the above-described control data, amplitude data and print data, which number is equal to the number of ejectors 32 included in the corresponding ejector group 34, are inputted in succession to the decoder 40.

The controller 12 relating to the present exemplary embodiment selectively outputs signals whose voltage levels are high level (H) and low level (L) to the latch signal line as the latch signals. In the state in which the controller 12 makes the latch signal be high level, the controller 12 outputs the first clock signal to the first clock signal line, and, synchronously with the first clock signal, serially outputs control data to the data signal line. Further, in the state in which the controller 12 makes the latch signal be low level, the controller 12 outputs the first clock signal to the first clock signal line, and, synchronously with the first clock signal, serially outputs print data or amplitude data to the data signal line.

When control data is inputted to the decoder 40, on the basis of that control data, the decoder 40 outputs to the latch selector 44 a control signal which instructs switching of the output destination of the data. Further, when print data or amplitude data is inputted to the decoder 40, the decoder 40 serially outputs the inputted print data or amplitude data to the data shift register 42.

The data shift register 42 temporarily stores the print data or the amplitude data which is the inputted serial data.

The controller 12 instructs the decoder 40 to cause output, to the latch selector 44, of the data which is stored in the data shift register 42. When the controller 12 relating to the present exemplary embodiment instructs the decoder 40 to cause output, to the latch selector 44, the data which is stored in the data shift register 42, the controller 12 outputs instruction pulses of a predetermined pattern to the latch signal line, without outputting the first clock signal to the first clock signal line.

When the aforementioned instruction pulses are inputted from the latch signal line to the decoder 40 without the first clock signal being inputted, the decoder 40 instructs the data shift register 42 to output data.

When the data shift register 42 is instructed by the decoder 40 to output data, the data shift register 42 converts the print data or the amplitude data, which is the stored serial data, into parallel data corresponding to the respective ejectors 32, and outputs the parallel data to the latch selectors 44 provided at the respective ejectors 32.

Hereinafter, only the one latch selector 44, first latching circuit 46, second latching circuit 48, level shifter 50, amplitude selector 52, waveform selector 60, level shifter 62, and driving waveform generating circuit 70 which are provided in correspondence with one of the ejectors 32, will be described. However, the same holds for the other ejectors 32 as well.

The first latching circuit 46 and the second latching circuit 48 are connected to the latch selector 44 as data output destinations which can be selected. The control signal outputted from the decoder 40 is inputted to the select terminal of the latch selector 44. Further, the parallel data is inputted from the data shift register 42 to the latch selector 44. Accordingly, the latch selector 44 outputs the inputted parallel data to the output destination instructed by the control signal.

The first latching circuit 46 or the second latching circuit 48 latches (self-holds) the parallel data outputted from the latch selector 44.

The first waveform shift register 54, the second waveform shift register 56, and the third waveform shift register 58 temporarily store the inputted waveform signals. On the basis of the inputted second clock signal, the first waveform shift register 54, the second waveform shift register 56, and the third waveform shift register 58 outputs the stored waveform signals. The timing of the outputting corresponds to the position, in the short-side direction of the inkjet recording head 14, of the corresponding ejector row in the aforementioned region of placement of the ejector group 34. For example, in a case in which 32 ejector rows are provided at the region of placement of the ejector group 34, and the frequency of the second clock signal is 10 MHz, and the driving timing of each ejector row is offset by one clock each, the offset time of each ejector row is 0.1 μs, and the total offset time of the driving timings at all of the ejector rows of the ejector group 34 is 3.2 μs.

The waveform signal A, the waveform signal B, and the waveform signal C are inputted as signals which are objects of selection, from the first waveform shift register 54, the second waveform shift register 56, and the third waveform shift register 58 to the waveform selector 60. Further, the parallel data latched by the second latching circuit 48 is inputted to the select terminal of the waveform selector 60. Accordingly, the waveform selector 60 selects and outputs the waveform signal for which selection is instructed by the parallel data, from among the waveform signal A, the waveform signal B, and the waveform signal C.

The waveform signal output terminal of the waveform selector 60 is connected to the level shifter 62. The waveform signal outputted from the waveform selector 60 is inputted to the level shifter 62.

When the waveform signal is inputted thereto, the level shifter 62 outputs a waveform signal S1 and a waveform signal S2 to the driving waveform generating circuit 70. The waveform signal S1 is obtained by inverting the waveform of the inputted waveform signal and converting the level of the inverted waveform to a predetermined voltage level. The waveform signal S2 is obtained by converting the level of the inputted waveform signal to the aforementioned predetermined voltage level.

On the other hand, the output terminal of the first latching circuit 46 is connected to the level shifter 50. The parallel data latched by the first latching circuit 46 is inputted to the level shifter 50. When the parallel data is inputted thereto, the level shifter 50 converts the level of the parallel data to a predetermined voltage level, and outputs the level-converted data. Note that, because the data inputted from the first latching circuit 46 is parallel data, in actuality, the level shifter requires only the number of bits of the parallel data.

The electric power of the first amplitude voltage level, the electric power of the second amplitude voltage level, and the electric power of the third amplitude voltage level are inputted from the respective amplitude setting terminals 17 to the amplitude selector 52 as electric powers which are objects of selection. The parallel data, whose level was converted by the level shifter 50, is inputted to the select terminal of the amplitude selector 52. The amplitude selector 52 outputs the electric power of the amplitude voltage level for which selection was instructed by the parallel data, from among the electric power of the first amplitude voltage level, the electric power of the second amplitude voltage level, and the electric power of the third amplitude voltage level.

The electric power output terminal of the amplitude selector 52 is connected to the driving waveform generating circuit 70. The electric power which is outputted from the amplitude selector 52 is supplied to the driving waveform generating circuit 70.

As shown in FIG. 3, the driving waveform generating circuit 70 relating to the present exemplary embodiment has a first signal generating circuit 72, a second signal generating circuit 74, and two N-channel MOS FETs (hereinafter called "NMOS") 76A, 76B.

The first signal generating circuit 72 relating to the present exemplary embodiment is structured as an inverter circuit which is structured by connecting in series a P-channel MOS FET (hereinafter called "PMOS") 72A and an NMOS 72B. Similarly, the second signal generating circuit 74 is structured as an inverter circuit which is structured by connecting in series a PMOS 74A and an NMOS 74B.

Namely, at the first signal generating circuit 72, the drains of the PMOS 72A and the NMOS 72B are connected to one another, and the gates of the PMOS 72A and the NMOS 72B are connected to one another. Similarly, at the second signal generating circuit 74 as well, the drains of the PMOS 74A and the NMOS 74B are connected to one another, and the gates of the PMOS 74A and the NMOS 74B are connected to one another.

The source of the PMOS 72A of the first signal generating circuit 72 is connected to the electric power outputting terminal of the amplitude selector 52, and electric power of the amplitude voltage level selected by the amplitude selector 52 is supplied thereto. The source of the NMOS 72B is grounded and is ground level. One output terminal of the level shifter 62 is connected to the respective gates of the PMOS 72A and the NMOS 72B, and the waveform signal S1 is inputted thereto from the level shifter 62.

At the first signal generating circuit 72, when the waveform signal S1 inputted from the level shifter 62 is high level, the PMOS 72A turns off and the NMOS 72B turns on, and therefore, the voltage level of the outputted signal is ground level. In contrast, when the waveform signal S1 inputted from the level shifter 62 is low level, the PMOS 72A turns on and the NMOS 72B turns off, and therefore, the voltage level of the outputted signal is the amplitude voltage level selected by the amplitude selector 52.

Namely, the first signal generating circuit 72 outputs, as a charging control signal for charging the piezoelectric element 30, a signal which is a waveform obtained by inverting the waveform of the inputted waveform signal S1. The high level of the charging control signal is the amplitude voltage level selected by the amplitude selector 52, and the low level is ground level. This charging control signal is a waveform of the same shape as the waveform signal selected by the waveform selector 60.

The signal output terminal of the first signal generating circuit 72 is connected to the gate of the NMOS 76A via a charging control signal line. The charging control signal outputted from the first signal generating circuit 72 is supplied to the gate of the NMOS 76A.

The drain of the NMOS 76A is connected to an electric power line which is connected to a driving power source (not shown), and DC electric power of a predetermined voltage level (in the present exemplary embodiment, a predetermined level in a range from 25 V to 30 V) is supplied thereto. Further, the source of the NMOS 76A is connected to a first line which is connected to the piezoelectric element 30.

Here, when the voltage level of the voltage applied to the gate of the NMOS 76A becomes higher than a voltage which is the sum of the voltage level of the source and a threshold value voltage Vth, the NMOS 76A turns on. Further, when the voltage level of the voltage applied to the gate of the NMOS 76A becomes less than or equal to the voltage which is the sum of the voltage level of the source and the threshold value voltage Vth, the NMOS 76A turns off.

On the other hand, the source of the PMOS 74A of the second signal generating circuit 74 is connected to a level shifter power source (not shown), and electric power of a predetermined voltage level HV (in the present exemplary embodiment, a predetermined level in a range from 25 V to 30 V) is supplied thereto. Further, the source of the NMOS 74B is grounded and is ground level. Moreover, the other output terminal of the level shifter 62 is connected to the respective gates of the PMOS 74A and the NMOS 74B, and the waveform signal S2 is inputted thereto from the level shifter 62.

At the second signal generating circuit 74, when the waveform signal S2 inputted from the level shifter 62 is high level, the PMOS 74A turns off and the NMOS 74B turns on, and therefore, the voltage level of the outputted voltage is ground level. In contrast, when the waveform signal S2 inputted from the level shifter 62 is low level, the PMOS 74A turns on and the NMOS 74B turns off, and therefore, the voltage level of the outputted voltage is the aforementioned predetermined voltage level HV.

Namely, the second signal generating circuit 74 outputs, as a discharging control signal for discharging the piezoelectric element 30, a signal which is a waveform obtained by inverting the waveform of the inputted waveform signal S2. The high level of the discharging control signal is the predetermined voltage level HV, and the low level is ground level. This discharging control signal is a waveform of a shape obtained by inverting the waveform of the waveform signal selected by the waveform selector 60.

The signal output terminal of the second signal generating circuit 74 is connected to the gate of the NMOS 76B via a discharging control signal line. The discharging control signal outputted from the second signal generating circuit 74 is supplied to the gate of the NMOS 76B.

The drain of the NMOS 76B is connected to a second line which is connected to the piezoelectric element 30 in parallel with the first line. The source of the NMOS 76B is grounded and is ground level.

Here, when the voltage level of the voltage applied to the gate of the NMOS 76B becomes higher than the threshold value voltage Vth, the NMOS 76B turns on. Further, when the voltage level of the voltage applied to the gate of the NMOS 76B becomes less than or equal to the threshold value voltage Vth, the NMOS 76B turns off.

Figure 4:
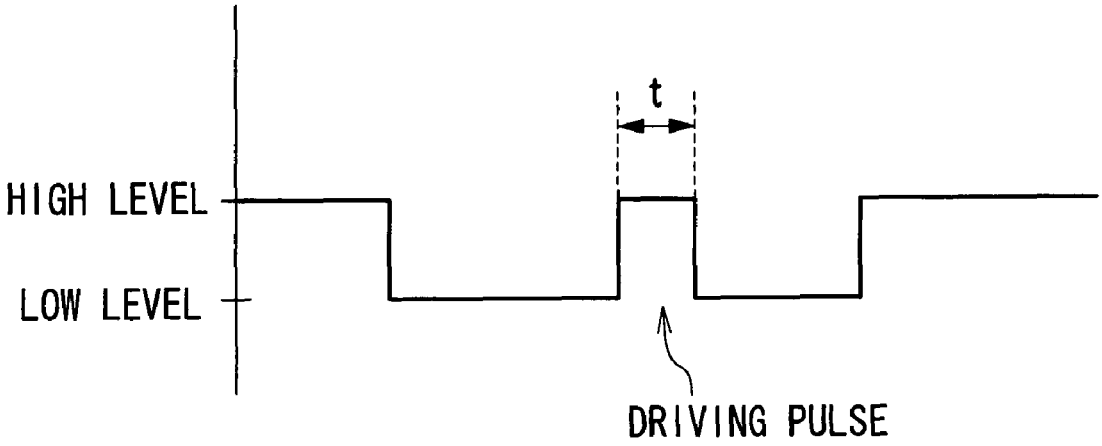
FIG. 4 is a waveform diagram showing an example of a waveform signal relating to the exemplary embodiments.

In the printer 10 relating to the present exemplary embodiment, three types which are "large droplet", "medium droplet" and "small droplet" are used as the types of the droplet amounts of the ink droplet which is ejected by driving the piezoelectric element 30. The controller 12 generates the waveform signal A, the waveform signal B, and the waveform signal C as waveform signals which cause ejection of these three types of ink droplets, respectively. At the driving IC 16, by applying plural voltages to the piezoelectric element 30 in this way, the number of power lines which must be made thick in consideration of the current, is reduced by connecting from the driving power source to the driving IC 16 by one electric power line. An example of a waveform signal generated by the controller 12 is shown in FIG. 4.

In the printer 10 relating to the present exemplary embodiment, by changing a pulse width t of the driving pulse included in the waveform signal, the droplet amount of the ink droplet ejected from the ejecting nozzle is changed to any of a large droplet, a medium droplet, and a small droplet. Driving pulses of different pulse widths t are included in the waveform signal A, the waveform signal B, and the waveform signal C. When the capacitive load is in a standby state, if the applied voltage is made to be a reference voltage, the reference voltage is high level in the case of FIG. 4. By selectively making the reference voltage differ, for example, in a case in which the capacitive load is charged to a voltage level of the same potential difference with the respective reference voltages being the standard, the lower the reference voltage, the less electric energy needed to charge the capacitive load.

Figure 5:
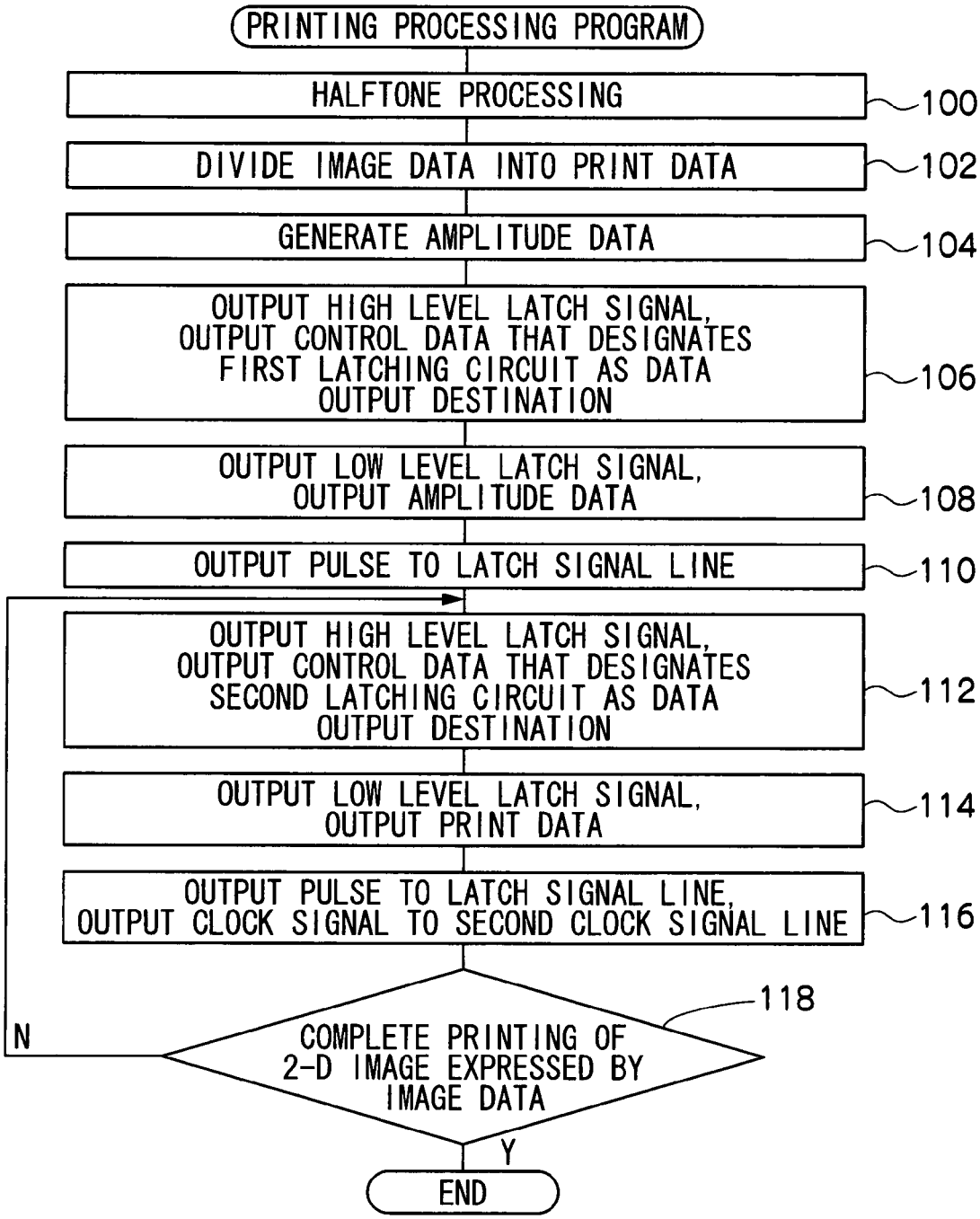
FIG. 5 is a flowchart showing the flow of processing of a printing processing program relating to the first exemplary embodiment.

Next, operation of the printer 10 relating to the present exemplary embodiment at the time of printing will be described with reference to FIG. 5. FIG. 5 is a flowchart showing the flow of processing of a printing processing program which is executed at the controller 12 at the time when image data, which expresses the image to be printed, is inputted from an external device (not shown). Note that, here, explanation will be given of a case in which an image of one page is printed.

In step 100 of FIG. 5, halftone processing using a dither method or an error diffusing method or the like is carried out on the inputted image data, and relatively high gradation image data of 256 gradations or the like for example is converted into image data of a number of gradations which can be recorded by the inkjet recording head 14.

In next step 102, the two-dimensional image expressed by the converted image data is divided into print data corresponding to elongated rectangular images which each are to be printed at one time by the inkjet recording head 14. The print data corresponding to the elongated rectangular image is further divided into print data which are to be printed by the respective ejector groups 34 provided at the inkjet recording head 14.

In next step 104, on the basis of the correction data which is stored in advance, amplitude data, which is for correcting the dispersion in the droplet amounts of the liquid droplets ejected from the respective ejectors 32 in the ejector group 34, is generated for each ejector group 34.

The correction data is data which prescribes, in advance, the amplitude voltage level which is used at each ejector 32. For example, if the droplet amount of the liquid droplet ejected from the ejector 32 is within a predetermined standard range, the amplitude voltage level which is to be used is stipulated to be the second amplitude voltage level. Further, if the droplet amount of the liquid droplet ejected from the ejector 32 is greater than the aforementioned standard range, the amplitude voltage level which is to be used is stipulated to be the first amplitude voltage level. Moreover, if the droplet amount of the liquid droplet ejected from the ejector 32 is less than the aforementioned standard range, the amplitude voltage level which is to be used is stipulated to be the third amplitude voltage level.

In subsequent step 106, a high level latch signal is outputted to the latch signal line. Further, in present step 106, the first clock signal is outputted to the first clock signal line, and, synchronously with the first clock signal, control data, which designate the first latching circuits 46 as the data output destinations of the respective latch selectors 44, are serially outputted to all of the data signal lines.

The decoder 40 outputs to the latch selector 44 a control signal that instructs the data output destination to be the first latching circuit 46. In accordance therewith, the latch selector 44 makes the data output destination be the first latching circuit 46.

In next step 108, a low level latch signal is outputted to the latch signal line. Further, in present step 108, the first clock signal is outputted to the first clock signal line. Synchronously with the first clock signal, the amplitude data of the respective ejectors groups 34 which were generated in above step 104 are serially outputted to the data signal lines connected to the driving ICs 16 corresponding to the respective ejector groups 34.

The decoder 40 outputs the inputted amplitude data to the data shift register 42. The data shift register 42 temporarily stores the inputted amplitude data.

In next step 110, the aforementioned instruction pulses are outputted to the latch signal line, without outputting the first clock signal to the first clock signal line.

In this way, the decoder 40 instructs the data shift register 42 to output data. In accordance therewith, the data shift register 42 converts the amplitude data which is stored serial data into parallel data, and outputs the parallel data to the latch selectors 44 which are provided in correspondence with the respective ejectors 32. The latch selector 44 outputs the inputted amplitude data to the first latching circuit 46. As a result, the amplitude data is latched by the first latching circuit 46. This latched amplitude data is held until updated by new amplitude data.

The level of the amplitude data latched by the first latching circuit 46 is converted by the level shifter 50, and the level-converted data is outputted to the amplitude selector 52. In accordance therewith, the amplitude selector 52 supplies, to the first signal generating circuit 72, the electric power of the amplitude voltage level instructed by the amplitude data from among the electric power of the first amplitude voltage level, the electric power of the second amplitude voltage level, and the electric power of the third amplitude voltage level which are supplied from the respective amplitude setting terminals 17.

In next step 112, a high level latch signal is outputted to the latch signal line. Further, in present step 112, the first clock signal is outputted to the first clock signal line, and, synchronously with the first clock signal, control data designating the second latching circuits 48 as the data output destinations of the respective latch selectors 44 are serially outputted to all of the data signal lines.

The decoder 40 outputs to the latch selector 44 a control signal that instructs the data output destination to be the second latching circuit 48. In accordance therewith, the latch selector 44 makes the data output destination be the second latching circuit 48.

In subsequent step 114, a low level latch signal is outputted to the latch signal line. Further, in present step 114, the first clock signal is outputted to the first clock signal line, and, synchronously with the first clock signal, the image data, which were obtained by dividing the elongated, rectangular image to be printed at one time into data for the respective ejector groups 34 in above step 102, are serially outputted to the data signal lines connected to the driving ICs 16 corresponding to the respective ejector groups 34.

In this way, the decoder 40 outputs the inputted print data to the data shift register 42. The data shift register 42 temporarily stores the inputted print data.

In next step 116, the aforementioned instruction pulses are outputted to the latch signal line, without outputting the first clock signal to the first clock signal line. Further, in present step 116, the second clock signal is outputted to the second clock signal line.

The decoder 40 instructs the data shift register 42 to output data. In accordance therewith, the data shift register 42 converts the print data which is stored serial data into parallel data, and outputs the parallel data to the latch selectors 44 provided in correspondence with the respective ejectors 32. The latch selector 44 outputs the inputted amplitude data to the second latching circuit 48. As a result, the print data is latched by the second latching circuit 48. This latched print data is held until updated by new print data.

The print data latched by the second latching circuit 48 is outputted to the waveform selector 60.

On the basis of the second clock signal inputted via the second clock signal line, the first waveform shift register 54, the second waveform shift register 56, and the third waveform shift register 58 output stored waveform signals at a timing corresponding to the position, in the short-side direction of the inkjet recording head 14, of the corresponding ejector row in the aforementioned region of placement of the ejector group 34.

As a result, the waveform selector 60 outputs, to the level shifter 62, the waveform signal for which selection is instructed by the print data, from among the waveform signal A, the waveform signal B, and the waveform signal C which are supplied from the first waveform shift register 54, the second waveform shift register 56, and the third waveform shift register 58.

The level shifter 62 outputs, to the first signal generating circuit 72, the waveform signal S1 which is obtained by inverting the waveform of the inputted waveform signal and converting the level thereof to a predetermined voltage level. Further, the level shifter 62 outputs, to the second signal generating circuit 74, the waveform signal S2 which is obtained by converting the level of the aforementioned inputted waveform signal to the aforementioned predetermined voltage level.

The first signal generating circuit 72 supplies the charging control signal, which is a waveform obtained by inverting the waveform of the inputted waveform signal S1, to the gate of the NMOS 76A. The high level of the charging control signal is the amplitude voltage level selected by the amplitude selector 52, and the low level thereof is ground level.

On the other hand, the second signal generating circuit 74 supplies the discharging control signal, which is a waveform obtained by inverting the waveform of the inputted waveform signal S2, to the gate of the NMOS 76B. The low level of the discharging control signal is ground level, and the high level thereof is the predetermined voltage level HV.

Examples of the charging control signal and the discharging control signal which are supplied from the first signal generating circuit 72 and the second signal generating circuit 74 are shown in FIG. 6A through FIG. 6C.

As shown in FIG. 6A and FIG. 6B, in the printer 10 relating to the present exemplary embodiment, the droplet amount of the ink droplet ejected from the ejecting nozzle is changed by changing the waveform signal which is used in ejecting a liquid droplet in accordance with print data and by changing the pulse width of the driving pulse included in the charging control signal and the discharging control signal from t1 to t2.

Further, as shown in FIG. 6A and FIG. 6C, in the printer 10 relating to the present exemplary embodiment, the high level voltage level of the charging control signal is adjusted by changing the amplitude voltage level in accordance with the amplitude data.

In order to prevent the NMOS 76A and the NMOS 76B from both turning on and through current from flowing to the piezoelectric element 30, at the time of raising the voltage level of either one of the charging control signal and the discharging control signal to high level, the voltage level of the other signal must be low level. In the printer 10 relating to the present exemplary embodiment, by adjusting the surface area or the size or the like of the transistors included in the level shifter 62, after the voltage levels of the waveform signal S1 and the waveform signal S2 outputted from the level shifter 62 both become high level once, the voltage level of either one of the waveform signal S1 and the waveform signal S2 falls to low level. Therefore, in the charging control signals and discharging control signals shown in FIG. 6A through FIG. 6C, after the voltage levels of the charging control signal and the discharging control signal both becomes low level once, the voltage level of either one of the charging control signal and the discharging control signal rises to high level.

Because the source of the NMOS 76A is connected to the piezoelectric element 30 via the first line, the voltage level of the source becomes equal to the voltage level of the charging voltage of the piezoelectric element 30. Further, because the drain of the NMOS 76B is connected to the piezoelectric element 30 via the second line, the voltage level of the drain becomes equal to the voltage level of the charging voltage of the piezoelectric element 30.

In a case in which the charging control signal is supplied to the NMOS 76A and the voltage level of the voltage applied to the gate is higher than the voltage level of the charging voltage of the piezoelectric element 30, the NMOS 76A turns on, and current flows from the drain to the source, and the piezoelectric element 30 is charged. When, due to this charging, the voltage level of the charging voltage of the piezoelectric element 30 rises and the voltage level of the source becomes equal to the voltage level of the voltage applied to the gate of the NMOS 76A, the NMOS 76A turns off.

The NMOS 76B operates similarly to the NMOS 76A, except that the voltage level of the source is fixed at ground level. Accordingly, when the discharging control signal is supplied to the NMOS 76B and the voltage level of the voltage applied to the gate becomes higher than the threshold value voltage Vth, the NMOS 76B turns on, and current flows from the drain to the source, and the piezoelectric element is discharged.

As described above, in an actual NMOS, if the potential difference between the gate and the source is greater than the threshold value voltage Vth, the on state and the off state switch. Therefore, the voltage level of the charging voltage charged to the piezoelectric element 30 becomes a voltage level which is offset by the threshold value voltage Vth. In FIG. 6A and FIG. 6B, the voltage level of the charging voltage of the piezoelectric element 30 is denoted as "substantially the second amplitude voltage level", and in FIG. 6C, the voltage level of the charging voltage of the piezoelectric element 30 is denoted as "substantially the first amplitude voltage level".

The piezoelectric element 30 expands or contracts the pressure generating chamber in accordance with the change in the voltage level of the charging voltage, and causes ejection of an ink droplet from the ejecting nozzle.

In next step 118, it is judged whether or not the printing of the two-dimensional image expressed by the image data is completed. If the judgment is negative, the routine returns to above step 112, whereas if the judgment is affirmative, the present printing processing program ends. Note that, when repeatedly executing the processings of above step 112 through step 118, the print data which corresponds to the image region to be printed next is the print data which is the object of processing.

Note that, in the present exemplary embodiment, explanation is given of a case in which the amplitude data is set only one time at the time of forming one image. However, the present invention is not limited to the same. For example, if the dispersion in the droplet amounts of the liquid droplets ejected from the respective ejectors 32 changes while one image is being formed, the amplitude data may be set plural times in accordance with the degree of change. Further, if the degree of change in the dispersion of the droplet amounts of the liquid droplets ejected from the respective ejectors 32 is small, the amplitude data may be set each time plural images are formed.

Second Exemplary Embodiment

The structure of the main portions of the printer 10 relating to a second exemplary embodiment is substantially the same as that of the above-described first exemplary embodiment (see FIG. 1). The controller 12 is connected to all driving ICs 16B by first waveform setting signal lines, second waveform setting signal lines and third waveform setting signal lines, instead of the first waveform signal line, the second waveform signal line, the third waveform signal line, and the second clock signal line.

Because the schematic structure of the inkjet recording head 14 is the same as that of the above-described first exemplary embodiment (see FIG. 2), description thereof is omitted here.

Figure 7:
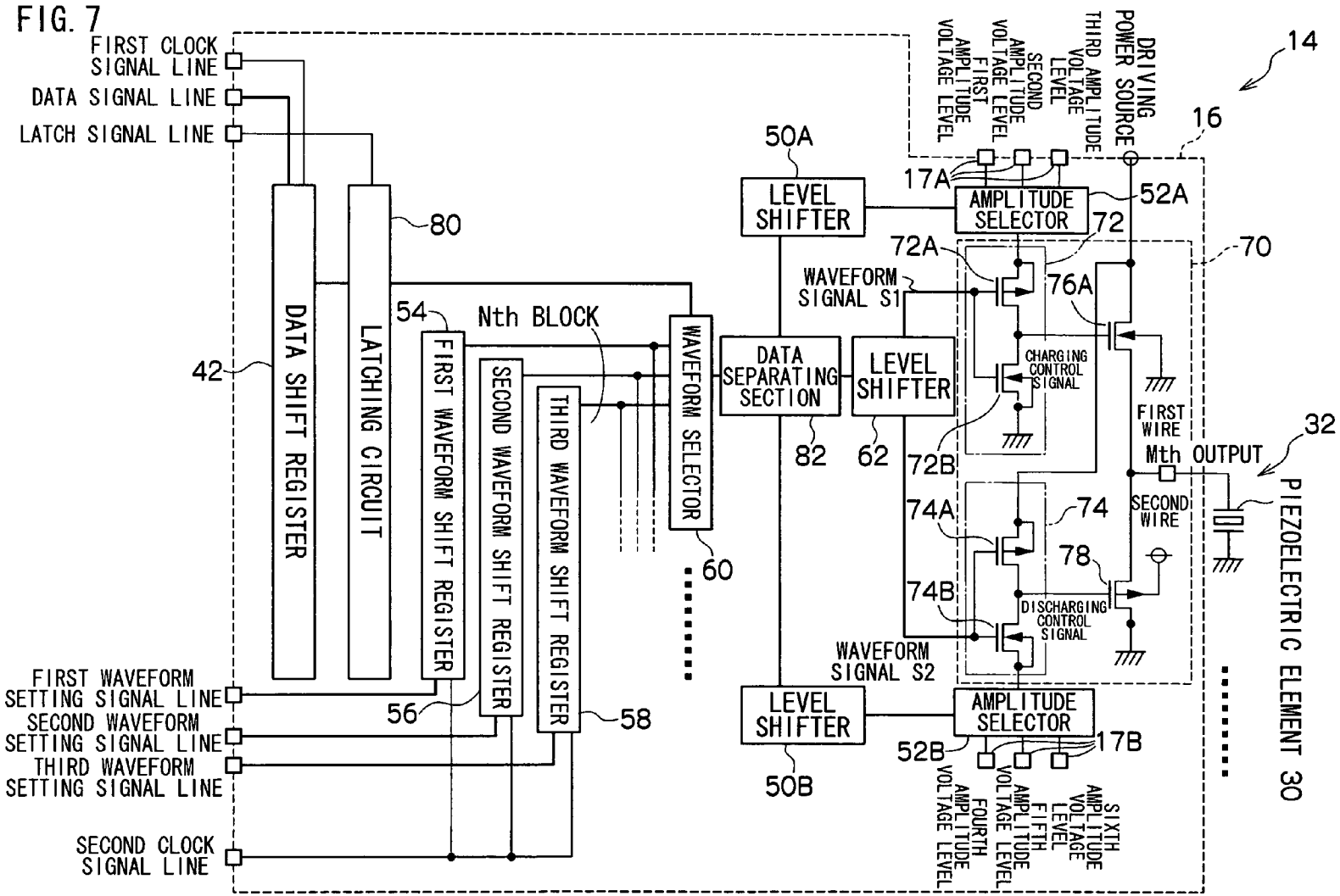
FIG. 7 is a block diagram (a partial circuit diagram) showing the structure of main portions of a driving IC relating to a second exemplary embodiment.

The structure of the driving IC 16B relating to the second exemplary embodiment is shown in FIG. 7. Note that explanation of portions which are the same in FIG. 7 and FIG. 3 is omitted.

The driving IC 16B relating to the present exemplary embodiment is connected to the controller 12 by a pair of first waveform setting signal lines, a pair of second waveform setting signal lines, and a pair of third waveform setting signal lines. Waveform setting signals A which are a pair of signals are supplied to the driving IC 16B via the first waveform setting signal lines, waveform setting signals B which are a pair of signals are supplied to the driving IC 16B via the second waveform setting signal lines, and waveform setting signals C which are a pair of signals are supplied to the driving IC 16B via the third waveform setting signal lines.

Plural (here, three) amplitude setting terminals 17A for charging and plural (here, three) amplitude setting terminals 17B for discharging are provided at the driving IC 16B relating to the present exemplary embodiment. Plural electric powers of respectively different voltage levels are supplied to each of the amplitude setting terminals 17A for charging and each of the amplitude setting terminals 17B for discharging. At the driving IC 16B relating to the present exemplary embodiment, electric power of a first amplitude voltage level (24 V in the present exemplary embodiment), electric power of a second amplitude voltage level (12 V in the present exemplary embodiment), and electric power of a third amplitude voltage level (5 V in the present exemplary embodiment) are supplied respectively to the three amplitude setting terminals 17A for charging from three power sources (not shown). Further, electric power of a fourth amplitude voltage level (12 V in the present exemplary embodiment) and electric power of a fifth amplitude voltage level (5 V in the present exemplary embodiment) are respectively supplied to two of the amplitude setting terminals 17B for discharging from two power sources (not shown). Moreover, one of the amplitude setting terminals 17B for discharging is grounded, and a sixth amplitude voltage level is ground level (0 V in the present exemplary embodiment).

The operation of the driving IC 16B relating to the present exemplary embodiment is controlled by the controller 12 using: the first clock signal supplied via the first clock signal line; the print data supplied via the data signal line; the latch signal supplied via the latch signal line; the waveform setting signals A supplied via the first waveform setting signal lines; the waveform setting signals B supplied via the second waveform setting signal lines; the waveform setting signals C supplied via the third waveform setting signal lines; the second clock signal supplied via the second clock signal line; and the like.

As shown in FIG. 7, the driving IC 16B relating to the present exemplary embodiment has the data shift register 42, a latching circuit 80, the first waveform shift register 54, the second waveform shift register 56, the third waveform shift register 58, the waveform selector 60, a data separating section 82, a level shifter 50A, a level shifter 50B, a amplitude selector (first selector) 52A, a amplitude selector (second selector) 52B, the level shifter 62, and the driving waveform generating circuit 70.

The first clock signal line and the data signal line are connected to the data shift register 42. The latch signal line is connected to the latching circuit 80.

The first waveform setting signal lines are connected to the first waveform shift register 54, the second waveform setting signal lines are connected to the second waveform shift register 56, and the third waveform setting signal lines are connected to the third waveform shift register 58. Further, the second clock signal line is connected in parallel to the first waveform shift register 54, the second waveform shift register 56, and the third waveform shift register 58.

The first clock signal and print data which are outputted from the controller 12 are inputted to the data shift register 42. The latch signal outputted from the controller 12 is inputted to the latching circuit 80. The waveform setting signals A outputted from the controller 12 are inputted to the first waveform shift register 54, the waveform setting signals B outputted from the controller 12 are inputted to the second waveform shift register 56, and the waveform setting signals C outputted from the controller 12 are inputted to the third waveform shift register 58. Moreover, the second clock signal outputted from the controller 12 is inputted to the first waveform shift register 54, the second waveform shift register 56, and the third waveform shift register 58, respectively.

The waveform setting signals are signals in which a waveform signal and amplitude control data are a pair of signals.

The amplitude control data is serial data structured from charging/discharging designating data, which designates whether a charging voltage is to be set or a discharging voltage is to be set, and amplitude data, which designates the amplitude voltage level to be used. In the present exemplary embodiment, for example, one-bit data in which "0" expresses that setting of the charging voltage is designated and "1" expresses that setting of the discharging voltage is designated, is used as the charging/discharging designating data. In the present exemplary embodiment, two-bit data is used as the amplitude data. For example, as the amplitude voltage levels to be used, "01" expresses that the first amplitude voltage level is to be utilized as the charging voltage and that the fourth amplitude voltage level is to be utilized as the discharging voltage, and "10" expresses that the second amplitude voltage level is to be applied for the charging voltage and that the fifth amplitude voltage level is to be applied for the discharging voltage, and "11" expresses that the third amplitude voltage level is to be applied for the charging voltage and that the sixth amplitude voltage level is to be applied for the discharging voltage.

The data shift register 42 temporarily stores print data which is serial data inputted from the controller 12, and converts this print data into parallel data of the respective ejectors 32, and outputs the parallel data to the latching circuits 80 which are provided in correspondence with the respective ejectors 32.

In accordance with the latch signal inputted via the latch signal line, the latching circuit 80 latches the print data which is parallel data outputted from the data shift register 42.

The first waveform shift register 54, the second waveform shift register 56, and the third waveform shift register 58 temporarily store the inputted waveform setting signals. Further, on the basis of the second clock signal inputted via the second clock signal line, the first waveform shift register 54, the second waveform shift register 56, and the third waveform shift register 58 output the stored waveform setting signals at a timing corresponding to the position, in the short-side direction of the inkjet recording head 14, of the ejector row in the aforementioned region of placement of the ejector group 34.

The waveform setting signals A, the waveform setting signals B, and the waveform setting signals C are inputted to the waveform selector 60 as signals which are objects of selection, from the first waveform shift register 54, the second waveform shift register 56, and the third waveform shift register 58. The print data, which is the parallel data latched by the latching circuit 80, is inputted to the select terminal of the waveform selector 60. The waveform selector 60 selects and outputs the waveform setting signals, for which selection is instructed by the print data, from among the waveform setting signals A, the waveform setting signals B, and the waveform setting signals C.

The waveform setting signal output terminal of the waveform selector 60 is connected to the data separating section 82. The waveform setting signals outputted from the waveform selector 60 are inputted to the data separating section 82.

The data separating section 82 separates the waveform signal and the amplitude control data which are included in the inputted waveform setting signals. Then, the data separating section 82 outputs the separated waveform signal to the level shifter 62. Further, the data separating section 82 refers to the charging/discharging designating data included in the separated amplitude control data, and if setting of the charging voltage is designated, the data separating section 82 outputs the amplitude data included in that amplitude control data to the level shifter 50A. If setting of the discharging voltage is designated, the data separating section 82 outputs the amplitude data included in the amplitude control data to the level shifter 50B.

The level shifter 50A and the level shifter 50B convert the level of the inputted amplitude data, and output the level-converted data.

The electric power of the first amplitude voltage level, the electric power of the second amplitude voltage level, and the electric power of the third amplitude voltage level are inputted from the respective amplitude setting terminals 17A for charging to the amplitude selector 52A as electric powers which are objects of selection. The amplitude data, which was level-converted by the level shifter 50A, is inputted to the select terminal of the amplitude selector 52A, and the electric power output terminal of the amplitude selector 52A is connected to the source of the PMOS 72A of the first signal generating circuit 72. Accordingly, the amplitude selector 52A selects the electric power, for which selection is instructed by the amplitude data, from among the electric power of the first amplitude voltage level, the electric power of the second amplitude voltage level, and the electric power of the third amplitude voltage level, and outputs the selected electric power to the source of the PMOS 72A.

The electric power of the fourth amplitude voltage level, the electric power of the fifth amplitude voltage level, and the electric power of the sixth amplitude voltage level are inputted from the respective amplitude setting terminals 17B for discharging to the amplitude selector 52B as electric powers which are objects of selection. The amplitude data, which was level-converted by the level shifter 50B, is inputted to the select terminal of the amplitude selector 52B, and the electric power output terminal of the amplitude selector 52B is connected to the source of the NMOS 74B of the second signal generating circuit 74. Accordingly, the amplitude selector 52B selects the electric power, for which selection is instructed by the amplitude data, from among the electric power of the fourth amplitude voltage level, the electric power of the fifth amplitude voltage level, and the electric power of the sixth amplitude voltage level, and outputs the selected electric power to the source of the NMOS 74B.

The driving waveform generating circuit 70 relating to the present exemplary embodiment has a PMOS 78 instead of the NMOS 76B.

The signal output terminal of the second signal generating circuit 74 is connected to the gate of the PMOS 78 via the discharging control signal line. The discharging control signal outputted from the second signal generating circuit 74 is supplied to the gate of the PMOS 78.

The source of the PMOS 78 is connected to the second line which is connected to the piezoelectric element 30 in parallel to the first line. The drain of the PMOS 78 is grounded and is ground level.

When the voltage level of the voltage applied to the gate of the PMOS 78 becomes lower than the voltage level of the source, the PMOS 78 turns on. When the voltage level of the voltage applied to the gate of the PMOS 78 becomes greater than or equal to the voltage level of the source, the PMOS 78 turns off.

When a waveform signal is inputted to the level shifter 62 relating to the present exemplary embodiment, the level shifter 62 generates the waveform signal S1 and the waveform signal S2 by inverting the waveform of the inputted waveform signal and converting the level thereof to a predetermined voltage level. Next, the level shifter 62 outputs the waveform signal S1 to the first signal generating circuit 72, and outputs the waveform signal S2 to the second signal generating circuit 74.

The first signal generating circuit 72 outputs a signal, which is a waveform obtained by inverting the waveform of the inputted waveform signal S1, as a charging control signal for charging the piezoelectric element 30. The high level of the outputted signal is the amplitude voltage level selected by the amplitude selector 52, and the low level is ground level.

At the second signal generating circuit 74, the source of the PMOS 74A is connected to the power source line connected to the driving power source. The second signal generating circuit 74 outputs a signal, which is a waveform obtained by inverting the waveform of the inputted waveform signal S2, as a discharging control signal for discharging the piezoelectric element 30. The high level of the outputted signal is the predetermined voltage level supplied from the power source line, and the low level is the amplitude voltage level selected by the amplitude selector 52B.

Namely, at the printer 10 relating to the present exemplary embodiment, the high level voltage level of the charging control signal and the low level voltage level of the discharging control signal can be controlled individually in accordance with the amplitude control data.

In order to prevent the NMOS 76 and the PMOS 78 from both turning on and through current from flowing to the piezoelectric element 30, at the time of raising the charging control signal to high level and turning the NMOS 76A on and charging the piezoelectric element 30, the discharging control signal must be made to be high level and the PMOS 78 must be turned off. Therefore, in the printer 10 relating to the present exemplary embodiment, by adjusting the surface area or the size or the like of the transistors included in the level shifter 62, the waveform signal S1 falls to low level after the waveform signal S2 becomes low level, and the waveform signal S1 rises to high level after the waveform signal S2 becomes high level. In this way, as shown in FIG. 8, with respect to the charging control signal outputted from the first signal generating circuit 72 and the discharging control signal outputted from the second signal generating circuit 74, the charging control signal rises to high level after the discharging control signal becomes high level, and the discharging control signal falls to low level after the charging control signal becomes low level.

In the printer 10 relating to the present exemplary embodiment, charging of the piezoelectric element 30, ejecting of the ink liquid, and discharging of the piezoelectric element 30 are carried out by the waveform setting signals A, the waveform setting signals B, and the waveform setting signals C. The controller 12 generates the waveform setting signals A, the waveform setting signals B, and the waveform setting signals C which carry out the charging of the piezoelectric element 30, the ejecting of the ink liquid from the ejector 32, and the discharging of the piezoelectric element 30.

Figure 8:
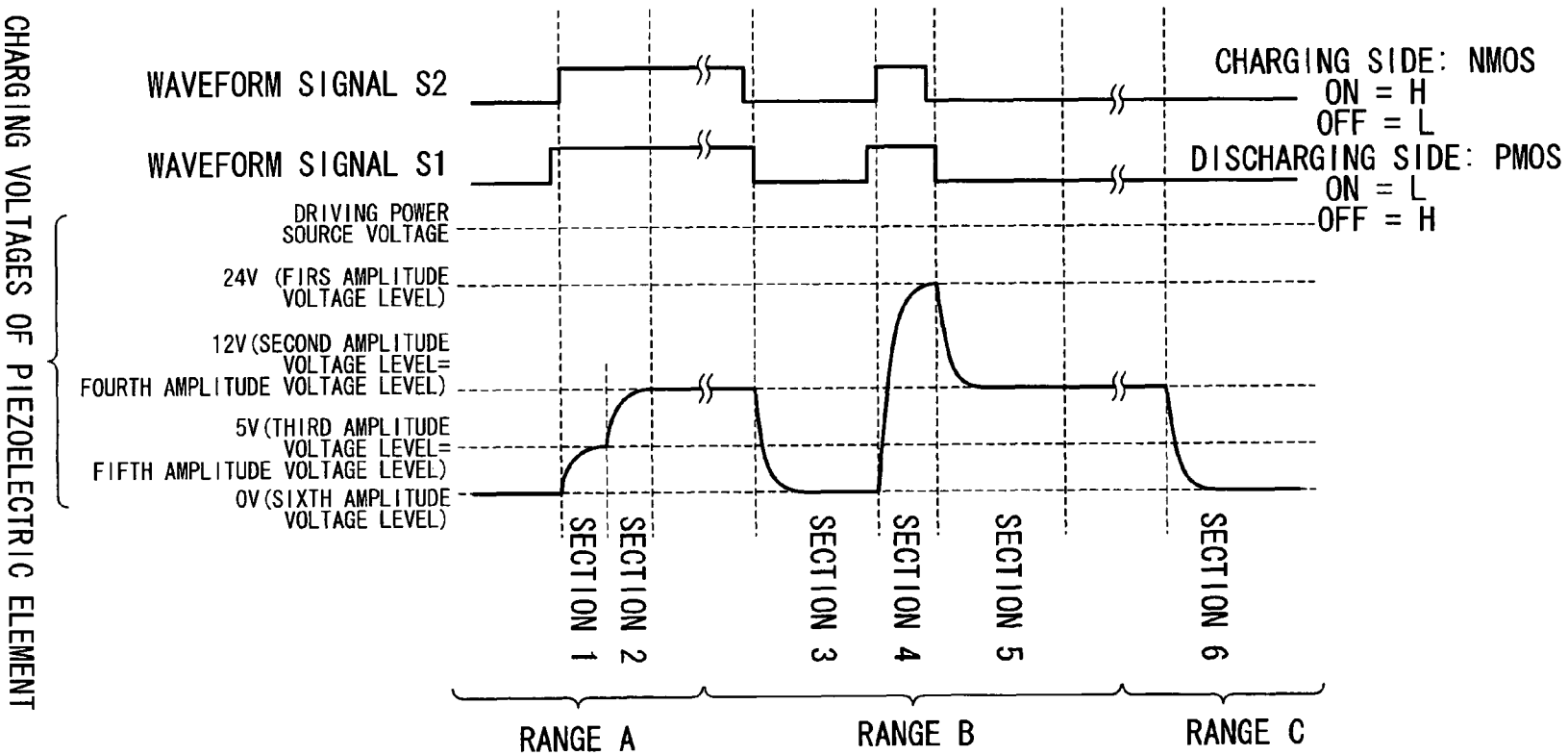
FIG. 8 is a waveform diagram showing examples of charging control signals and discharging control signals relating to the second exemplary embodiment.

For example, as shown in range A in FIG. 8, as the waveform setting signals A, from the waveform signal A, the charging control signal and the discharging control signal are generated, and from the amplitude control data, the third amplitude voltage level is designated as the amplitude voltage level which is used in section 1, and the second amplitude voltage level is designated as the amplitude voltage level which is used in section 2. In this way, the piezoelectric element 30 is charged in stages, and incorrect ejection of liquid droplets from the ejecting nozzle is prevented.

For example, as shown in range B in FIG. 8, as the waveform setting signals B, from the waveform signal B, the charging control signal and the discharging control signal are generated, and from the amplitude control data, the sixth amplitude voltage level is designated as the amplitude voltage level which is used in section 3, the first amplitude voltage level is designated as the amplitude voltage level which is used in section 4, and the fourth amplitude voltage level is designated as the amplitude voltage level which is used in section 5. In this way, the piezoelectric element 30 expands and contracts the pressure generating chamber, and a liquid droplet is ejected from the ejecting nozzle.

For example, as shown in range C in FIG. 8, as the waveform setting signals C, from the waveform signal C, the charging control signal and the discharging control signal are generated, and from the amplitude control data, the sixth amplitude voltage level is designated as the amplitude voltage level which is used in section 6. In this way, the charging voltage of the piezoelectric element 30 returns to the initial state.

In the above-described second exemplary embodiment, explanation is given of a case in which the amplitude setting terminals 17A for charging and the amplitude setting terminals 17B for discharging are provided separately from one another. However, the present invention is not limited to the same. For example, in a case in which there is a same amplitude voltage level for charging and for discharging, electric power may be supplied for both from either one terminal. Namely, in the second exemplary embodiment, because the second amplitude voltage level and the fourth amplitude voltage level are the same voltage levels, and the third amplitude voltage level and the fifth amplitude voltage level are the same voltage levels, electric powers may be supplied for both from either one terminal in each case. Further, at least one amplitude voltage level for the charging voltage and at least one amplitude voltage level for the discharging voltage may be the same voltage level.

In the above-described respective exemplary embodiments, explanation is given of a case in which the inkjet recording head 14 is an elongated head formed to be wider than the width of the recording sheet, and an image is recorded by moving the recording sheet with respect to the elongated head. However, the present invention is not limited to the same. For example, the present invention may be applied to an inkjet printer which forms an image on a recording sheet while reciprocally moving an inkjet recording head with respect to the recording sheet.

Further, the structure of the printer 10 (see FIG. 1), the structure of the inkjet recording head 14 (see FIG. 2), and the structures of the driving ICs 16, 16B (see FIG. 3 and FIG. 7) which were described in the above exemplary embodiments are examples, and can be changed appropriately within a scope which does not depart from the gist of the present invention.

The waveform signals (FIG. 4) described in the above respective exemplary embodiments also are examples, and can be changed appropriately within a scope which does not depart from the gist of the present invention.

The flow of the processings of the printing processing program (see FIG. 5) described in the above exemplary embodiments also is an example, and can be changed appropriately within a scope which does not depart from the gist of the present invention.

Further, the printer 10 described in the above respective exemplary embodiments forms an image (including characters) on a recording medium, but the printer 10 is not limited to the same. Namely, the recording medium is not limited to a recording sheet, and the liquid which is ejected is not limited to an ink liquid. For example, the present invention can be applied as well to other image forming devices such as a pattern forming device which ejects liquid droplets on a sheet-like substrate for pattern formation of a semiconductor, a liquid crystal display device or the like, and the like.

Moreover, in the above-described respective exemplary embodiments, explanation is given of an example in which a piezoelectric element is used as the capacitive load, but the present invention is not limited to the same. For example, the same effects can be achieved when using an electrostatic actuator, where one of opposing electrodes is made to be an elastic electrode and the electrostatic actuator uses the displacement of the elastic electrode due to electrostatic force, or a liquid crystal, or the like, instead of a piezoelectric element.

As described above, in accordance with the above-described capacitive load driving circuit, by controlling the voltage level of the voltage which is applied to the gate via the charging control signal line, the voltage level of the charging voltage which is charged to the capacitive load via the source can be controlled. Therefore, as compared with a case in which the present structure is not provided, the droplet amount of the liquid droplet which is ejected can be adjusted without complex control being carried out.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A capacitive load driving circuit connected to a capacitive load that causes ejection, from an ejecting nozzle, of a liquid droplet of a droplet amount that corresponds to a voltage level of charging voltage, the capacitive load driving circuit comprising:

a first line that applies the charging voltage to the capacitive load;

a power source line carrying dc voltage that is supplied from a power source for driving of the capacitive load;

a charging control signal line that controls a voltage level of the charging voltage with respect to the capacitive load;

an N-type electric field effect transistor to whose source the first line is connected, and to whose drain the power source line is connected, and to whose gate the charging control signal line is connected; and a first selector selecting, from among a plurality of voltages whose voltage levels are respectively different and are less than or equal to a voltage level of the dc voltage, a voltage level of a voltage to be applied to the gate of the N-type electric field effect transistor via the charging control signal line.

2. The capacitive load driving circuit of claim 1, further comprising:

a second line connected to the capacitive load in parallel with the first line;

a ground line whose voltage level is ground level;

a discharging control signal line that controls a voltage level of charging voltage of the capacitive load at a time when the charging voltage is discharged through the ground line and decreases; and a P-type electric field effect transistor to whose source the second line is connected, and to whose drain the ground line is connected, and to whose gate the discharging control signal line is connected.

3. The capacitive load driving circuit of claim 2, further comprising a second selector selecting, from among a plurality of voltages whose voltage levels are respectively different and are less than or equal to a voltage level of the dc voltage, a voltage level of a voltage to be applied to the gate of the P-type electric field effect transistor via the discharging control signal line.

4. The capacitive load driving circuit of claim 3, further comprising a supplying section that supplies to the charging control signal line a charging control signal including a pulse whose pulse width differs in accordance with the droplet amount of the liquid droplet to be ejected from the ejecting nozzle and whose high level is the voltage level selected by the first selector, and supplies to the discharging control signal line a discharging control signal including a pulse whose waveform is obtained by inverting a waveform of a pulse supplied to the charging control signal and whose low level is the voltage level selected by the second selector.

5. An image forming device comprising:

the capacitive load driving circuit of claim 1;

an ejecting nozzle from which a liquid droplet of a chromatic ink liquid is ejected; and a capacitive load provided in correspondence with the ejecting nozzle, and forming an image on a recording medium by causing ejection, from the ejecting nozzle, of the liquid droplet of a droplet amount that corresponds to a voltage level of charging voltage from the capacitive load driving circuit.

6. The capacitive load driving circuit of claim 1, wherein the plurality of voltages that are different and that are selected by the first selector are three voltage levels.

7. The capacitive load driving circuit of claim 3, wherein the plurality of voltages that are different and that are selected by the second selector are three voltage levels.

8. The image forming device of claim 5, wherein the capacitive load is a piezoelectric element.

9. A capacitive load driving circuit comprising an N-type electric field effect transistor to whose source is connected a first line that is connected to a capacitive load causing ejection, from an ejecting nozzle, of a liquid droplet of a droplet amount corresponding to a voltage level of charging voltage, and that applies the charging voltage to the capacitive load, and to whose drain is connected a power source line carrying dc voltage that is supplied from a power source for driving of the capacitive load, and to whose gate is connected a charging control signal line that controls a voltage level of charging voltage with respect to the capacitive load via the source, and a first selector selecting, from among a plurality of voltages whose voltage levels are respectively different and are less than or equal to a voltage level of the dc voltage, a voltage level of a voltage to be applied to the gate of the N-type electric field effect transistor via the charging control signal line.

10. The capacitive load driving circuit of claim 9, further comprising a P-type electric field effect transistor to whose source is connected a second line connected to the capacitive load in parallel with the first line, and to whose drain is connected a ground line whose voltage level is ground level, and to whose source is connected a discharging control signal line that controls a voltage level of charging voltage of the capacitive load at a time when the charging voltage is discharged via the drain through the ground line and decreases.

11. An image forming device comprising:

the capacitive load driving circuit of claim 9;

a capacitive load provided in correspondence with an ejecting nozzle from which a liquid droplet of a chromatic ink liquid is ejected, and forming an image on a recording medium by causing ejection, from the ejecting nozzle, of the liquid droplet of a droplet amount that corresponds to a voltage level of charging voltage from the capacitive load driving circuit.

* * * * *